US006889517B1

(12) United States Patent
Dehli

(10) Patent No.: US 6,889,517 B1
(45) Date of Patent: May 10, 2005

(54) HEATED DISPENSER DOOR AND METHOD

(75) Inventor: Diane Marie Dehli, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/475,594

(22) Filed: Dec. 30, 1999

(51) Int. Cl.[7] ..... F25D 21/06; F25C 5/08; H05B 3/06

(52) U.S. Cl. ..... 62/275; 62/351; 219/522

(58) Field of Search ..... 62/272, 275, 351; 219/522, 535

(56) References Cited

U.S. PATENT DOCUMENTS 2,420,240 A 5/1947 Haggerty
3,055,193 A * 9/1962 Smith ..... 62/440
3,177,345 A * 4/1965 Plumat ..... 219/543
3,633,374 A 1/1972 Canter
4,205,533 A * 6/1980 Sterling ..... 62/131
4,555,049 A * 11/1985 Mawby et al. ..... 222/517
4,774,397 A * 9/1988 Grise ..... 219/549
5,029,737 A * 7/1991 Yamamoto ..... 222/526
5,269,154 A * 12/1993 Schmidt ..... 62/275
5,442,933 A * 8/1995 Unger ..... 62/275
6,533,003 B1 * 3/2003 Jacobus et al. ..... 141/360

* cited by examiner

*Primary Examiner*—William C. Doerrler
(74) *Attorney, Agent, or Firm*—H. Neil Houser, Esq.; Armstrong Teasdale LLP

(57) ABSTRACT

A method of heating a dispenser door by applying direct heat to only a peripheral region of a front layer of the door at a rate sufficient to heat an edge surface of the door to a point above zero degrees Centigrade. In one embodiment this is done by placing a perimeter heater in a flange attached to the rear end of a tubular wall extending from the periphery of a central region of the front layer of the door.

20 Claims, 3 Drawing Sheets

HEATED DISPENSER DOOR AND METHOD

BACKGROUND OF THE INVENTION

This invention relates to ice makers, and, more particularly, to duct doors for dispensers.

Heated jambs around the periphery of refrigerator doors are known for the purpose of preventing frost, the heating being done by convection air flow, fluid flow or other suitable means through a passage in a fixed-position door jamb seal. See, for example, U.S. Pat. No. 2,420,240. A heated circular jamb is also known for round icemaker doors. See, for example, U.S. Pat. No. 5,42,933. It is known to have a heater placed over the entire surface between the insulation and outer door of a dispensing duct of an ice dispenser to help eliminate sweating by heating the exterior face of the icemaker door. See, for example, U.S. Pat. No. 5,269,154.

Heating the door jamb tends to transfer heat to the surrounding refrigerator and thus be inefficient. Heating the entire surface of the dispenser door makes the door warm or hot and is thus inefficient.

It would be desirable to heat the door in a manner to prevent condensation and prevent freezing shut of the door in a more efficient and effective manner.

BRIEF SUMMARY OF THE INVENTION

In one embodiment a dispenser has a round disc-like door with a heater element adjacent a peripheral region of the door to heat the portion of the door which seats and seals against a doorjamb and to heat an outer frontal area of the door. The peripheral location provides superior prevention against the door freezing shut and introduces heat at the location where the greatest heat loss is likely to occur. The peripheral heating is sufficient to heat, by conduction through the outer layer, the outer layer to a temperature sufficient to significantly reduce any tendency for condensation to form on the outside of the door.

DETAILED DESCRIPTION OF THE INVENTION

Figure 1:
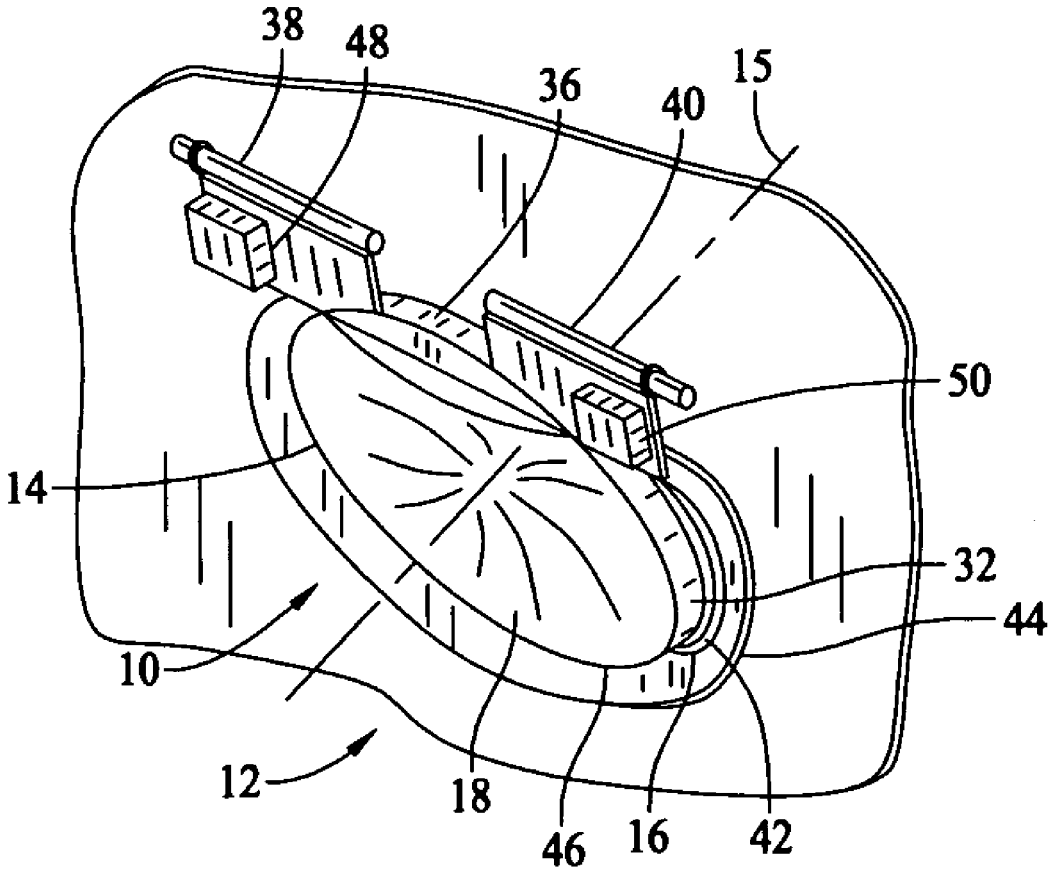
FIG. 1 is a front upper right perspective view of an outer portion of a heated dispenser outlet door.
Figure 2:
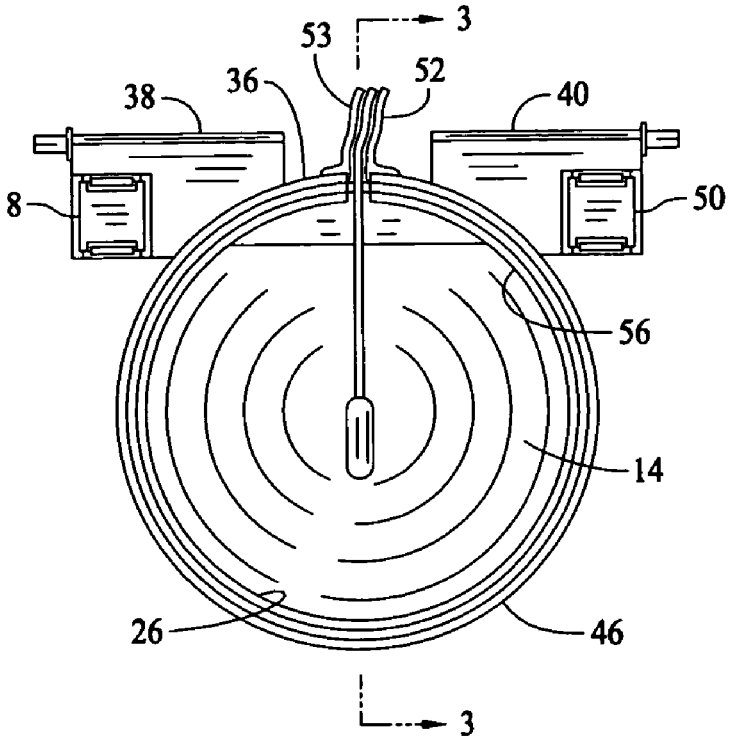
FIG. 2 is front view of an outer portion of a heated dispenser outlet door showing a front layer, a peripheral heater, pivot and insulation layer showing the peripheral heater in phantom.
Figure 3:
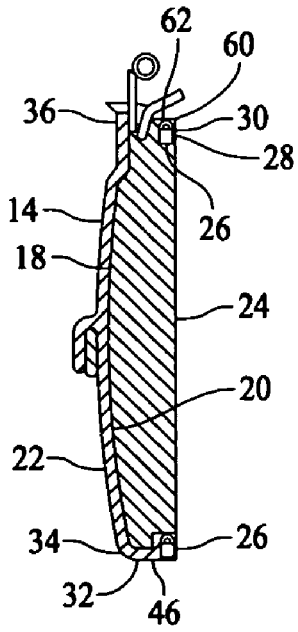
FIG. 3 is a cross-sectional view taken along lines 3—3 of FIG. 2.

FIGS. 1 through 3 are perspective, front and cross-sectional views of a front outer portion 10 of a heated dispenser outlet door 12. Outer portion 10 includes a front layer 14 having a peripheral region 16, a central region 18, an inner surface 20 and an outer surface 22. An insulation layer 24 is placed between front layer 14 and a rear layer.

A perimeter heater 26 is disposed on peripheral region 16 with insulation layer 24 between inner surface 20 and heater 26. Heater 26 is in heat direct heat transfer communication with only peripheral region 16 of inner surface 20 and is spaced from central region 18 by peripheral region 16 and insulation layer 24. In various alternative embodiments, heater 26 is located elsewhere on peripheral region 16 than that illustrated in FIG. 16, including positions closer to outer surface 22, without departing from the scope of the present invention.

Front layer 14 is an outwardly convex disc, although other shapes such as a concave disc, a rectangular plate, a polygonal plate, a flat plate, a convex plate, an oval plate, or any combination of such shapes or other shapes can be used. Layer 14 is made of ABS or other similar material, although many materials may be selected since the primary heating of central region 18 comes from ambient air. Insulation layer 24 is of the same or different shape as the rear cover (described below).

Figure 4:
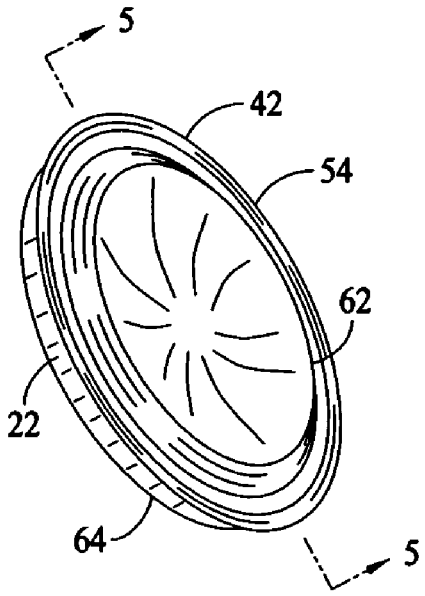
FIG. 4 is a perspective view of a rear layer adapted to fit the outer portion of FIG. 1.

Heater 26 is looped around and within a flange 28 at the rear end 30 of a circular tubular wall 32 attached at an outer perimeter 34 of front layer 14. Wall 32 and flange 28 form all or part of the peripheral region 16. Heater 26 can alternatively be located in wall 32 or near the front outer edge 34 of layer 14, if that produces sufficient heat transfer to the desired areas (described below.) Referring also to FIG. 4, since the primary source of heat loss from portion 10 is at a door seal 42 and flange 28, it is efficient to place the heater 26 there. This placement maximizes the likelihood that sufficient heat will be communicated to door seal 42 and a doorjamb 44 to prevent freezing of seal 42 to jamb 44. Freezing of seal 42 to jamb 44 would render door 12 inoperable. Heat from heater 26 flows rearwardly and outwardly to the seals and jamb and forwardly and inwardly to front layer 14. Insulation layer 24 prevents much heat from layer 14 into any cool region behind layer 24, and central region 18 is also heated by the ambient air with which it is in contact. This allows front layer 14 to assume the temperature of ambient air or perhaps be slightly warmer due to the limited heat transfer through the front layer 14. A second heater (not shown) could be placed in doorjamb 44 if desired to assure both sides 42, 44 of the door seal-to-doorjamb interface are provided with sufficient heat energy to offset any heat loss at the interface.

Door 12 is attached at an upper side 36 to a left hinge 38 and a right hinge 40 to allow a bottom end 46 of door 12 to swing open. Upper side 36 can be tilted forwardly (outwardly) relative to bottom end 46 so that the gravity neutral position of door 12 is slightly open. Left magnet 48 and right magnet 50 can be provided to hold door 12 shut against the force of gravity tending to open it. This allows falling crushed ice behind door 12 to rapidly open door 12 and to fully empty before magnets 48 and 50 pull door 12 back up shut.

Heater 26 is shown in phantom lines in FIG. 2 because it is embedded in flange 28. Heater 26 is electrically connected to electrical leads 52 and 53 extending from upper side 36. Upper side 36 is configured to be connected to hinges 38 and 40. Heater 26 is shown as a 350-degree circular loop 56 with the remaining ten degrees open adjacent upper end to allow leads 52 and 53 to connect to loop 56. Loop 56 conforms in shape to peripheral region 16 for heating peripheral region 16 when placed adjacent thereto. Loop 56 surrounds a central loop region 58 that conforms in shape to, but is larger than, central region 18 of door 12. This larger size of region 58 avoids heater 26 directly heating central region 18, which prevents having central region 18 from getting too warm. Leads 52 are configured to be connected to a source of electrical power outside peripheral region 16. In one embodiment, central region 18 includes a light (not shown), such as a light emitting diode to illuminate a dispenser outlet adjacent door 12.

Figure 5:
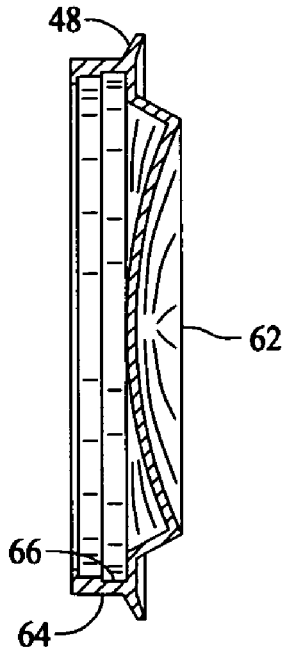
FIG. 5 is a vertical cross sectional view taken along lines 5—5 of FIG. 4.

FIG. 4 is an exemplary perspective view of one embodiment of a rear layer 54 adapted to fit outer portion 10. FIG. 5 is a cross-section taken along line 5—5 of FIG. 4. Rear layer 54 has a concave dish shape with a main rear portion 62 and a forwardly projecting wall 64. Wall 64 has a radial groove 66 conforming in shape to and adapted to engage outward portion 29 of flange 28.

The operation of door 12 will next be described. Heat is applied directly to only peripheral region 16, of a rear surface 60 of front layer 14. This heat is applied at a rate sufficient to heat peripheral region 16 to a point above zero degrees Centigrade. This applied heat is, in turn, conducted from peripheral region 16 to an outer surface 22 at a rate sufficient to heat outer surface 22 to a temperature above the dew point of ambient air so as to prevent condensation on outer surface 22. Peripheral region 16 is annular and only a minimal amount of the applied heat is conducted to the outer surface 22 and that conduction occurs primarily through front layer 14. Passing an electrical current through heater 26, which is coaxial with and immediately rearward of peripheral region 16, generates the heat being applied.

A three-step process can construct door 12. First loop 56 is placed in heat transfer communication with and rearward of only peripheral region 16 of rear surface 60 of a front layer 14. Second, insulation layer 24 is placed rearward of heater 26. Third the heater 26 is connected to a source of energy within the dispenser (not shown) but external to the door. Placing rear layer 54 rearward of insulation 24 can improve the construction by minimizing heat loss from front layer 14 to rear layer 54. Another alternative is connecting the front and rear layers 14 and 54 at their outer perimeters to encapsulate the heater element and insulation while permitting the passage of heat producing energy into the heater element from outside door 12. This is seen in FIGS. 3 and 6, where flange 28 is has a radially outward directed annular portion 62 extending beyond wall 26. To lock onto portion 62, rear layer 54 has a forwardly projection wall 64 which conforms to but is of slightly larger diameter than wall 26. Wall 64 has an internal annular groove 66 that conforms to and is adapted to engage portion 62 to lock rear layer 54 onto front layer 14. This is a useful locking arrangement, but other locking arrangements such as fasteners of various types, snap rings, detent mechanisms, or the like, could be used.

While the invention has been described in terms of various specific embodiments, those skilled in the art will recognize that the invention can be practiced with modification within the spirit and scope of the claims.

What is claimed is:

1. A method of heating a dispenser door, comprising the steps of:

applying direct heat with a heater to only a peripheral region of a rear surface of a front layer of the door at a rate sufficient to heat the peripheral region of the door to a point above zero degrees Centigrade but not sufficient to significantly heat a central region of the front layer, conducting heat from the peripheral region to an outer surface of the front layer at a rate sufficient to heat the outer surface to a temperature above a dew point of ambient air so as to prevent condensation on the outer surface; and insulating the door between the heater and the central region of the front layer.

2. A method of heating in accordance with claim 1 wherein the peripheral region is annular and said conducting is done through the peripheral region of the front layer.

3. A method of heating in accordance with claim 2 wherein the heat is generated by passing an electrical curt through a heater element coaxial with and rearward of the peripheral region.

4. A method in accordance with claim 1 wherein the beat is generated in a rear portion of a sidewall of the front layer.

5. A method in accordance with claim 4 wherein heat is generated in a flange attached to a rear end of a sidewall of the front layer.

6. A method of constructing a dispenser door, which comprises the steps of:

placing a heater element in heat transfer communication with and rearward of only a peripheral region of a front layer of the door;

placing insulation between the heater and a central region of the front layer; and connecting the heater element with a source of energy within the dispenser but external to the door.

7. A method in accordance with claim 6 wherein the insulation is placed at least partially forward of the heater.

8. A method in accordance with claim 6 further comprising the steps of:

enclosing the insulation by placing a rear cover layer rearward of the insulation; and connecting the front and rear layers at their outer perimeters to encapsulate the heater element and insulation while permitting the passage of heat producing energy into the heater element from outside the door.

9. A method in accordance with claim 8 further comprising heating the junction of the front and rear layers with the heater element.

10. A method in accordance with claim 9 further comprising lighting the central region with a light.

11. A heated dispenser outlet door, said outlet door comprising:

a front layer having a peripheral region and a central region;

a rear layer;

a perimeter heater disposed between said front layer and said rear layer in heat direct transfer communication with only the peripheral region of said front layer and spaced from said central region, so as to direct heat from said heater into only said peripheral region; and insulation positioned between said perimeter heater and said central region of said front layer.

12. A door in accordance with claim 11 further comprising a light in said central region.

13. A door in accordance with claim 12 wherein said light comprises a light emitting diode.

14. A door in accordance with claim 11 wherein said insulation is disposed at least partly in front of said heater between said heater and said central region.

15. A door in accordance with claim 11 wherein said peripheral region is a tubular wall extending rearwardly from said central region.

16. A door in accordance with claim 13 wherein said heater element is disposed at a rear end of said tubular wall.

17. A door in accordance with claim 14 wherein said tubular wall has an inward radial ledge at said rear end and said element is located at inward radial portion of said ledge.

18. A door in accordance with claim 14 wherein said front layer is an outwardly convex disc.

19. A door in accordance with claim 11 wherein said heater is looped around said peripheral region.

20. A door in accordance with claim 11 wherein the door is configured to be attached to a hinge.

* * * * *

UNITED STATES PATENT AND TRADEMARK OFFICE

CERTIFICATE OF CORRECTION

PATENT NO. : 6,889,517 B1
DATED : May 10, 2005
INVENTOR(S) : Diane Marie Dehli

It is certified that error appears in the above-identified patent and that said Letters Patent is hereby corrected as shown below:

Column 4,
Line 1, delete “beat” and insert therefor -- heat --.

Signed and Sealed this

Twenty-seventh Day of September, 2005

JON W. DUDAS
*Director of the United States Patent and Trademark Office*